United States Patent [19]

Hudson

[11] 4,388,182

[45] Jun. 14, 1983

[54] MINERAL SEPARATION BY PARTICLE SETTLING CHARACTERISTICS

[76] Inventor: H. Gene Hudson, 10625 N. 37th Way, Phoenix, Ariz. 85028

[21] Appl. No.: 295,150

[22] Filed: Aug. 21, 1981

[51] Int. Cl.[3] ..... B03B 5/66

[52] U.S. Cl. ..... 209/17; 209/18; 209/158; 209/495; 251/7

[58] Field of Search ..... 209/17, 18, 155–161, 209/454–456, 486, 497, 494–496, 208, 209, 458; 222/214, 504; 251/7

[56] References Cited

U.S. PATENT DOCUMENTS

| | | | |
|---|---|---|---|
| 1,334,765 | 3/1920 | Lioud | 209/157 |
| 1,605,172 | 11/1926 | Chance | 209/161 X |
| 2,211,895 | 8/1940 | Hoyois | 209/454 |
| 2,315,536 | 4/1943 | McNeill | 209/159 X |
| 2,418,821 | 4/1947 | Coghill et al. | 209/495 X |
| 3,511,375 | 5/1970 | Lang | 209/496 X |
| 4,328,093 | 5/1982 | Zrnic et al. | 209/497 X |

FOREIGN PATENT DOCUMENTS

| | | | |
|---|---|---|---|
| 974787 | 2/1951 | France | 209/495 |
| 17011 | of 1913 | United Kingdom | 209/158 |
| 371174 | 4/1932 | United Kingdom | 209/155 |

*Primary Examiner*—Ralph J. Hill
*Attorney, Agent, or Firm*—James F. Duffy

[57] ABSTRACT

Method and apparatus 10 permits material immersed in a body of fluid to move under the influence of gravity across inclined surfaces 14 and 24 having an angle of incline below the horizontal approximately equivalent to that of the repose angles $\alpha$ and $\beta$ of the fluid-immersed material. Such materials are moved under the influence of gravity rather than fluid forces to winnowing channels 25 comprising closed regions of finite length through which an upwelling flow of fluid at relatively high velocity passes into the fluid body in which the material is immersed. Undesired materials pass upward, borne on the upwelling flow through the fluid body while desired materials 36 move through winnowing channels 25 counter to the upwelling flow, passing along surface 251 at the repose angle $\beta$ of such material within the region of relatively high fluid velocity in accord with the material's fluid settling characteristics. Material 36 which successfully traverses winnowing channels 25 and is not thereafter borne upward on the upwelling flow settles to individual flexible walled collection means 33. Fluid isolation means 341 and 342 capable of compressing the flexible walls of the collection means 33, permit the recovery of particulate material 36 from said collection means 33 without modulating the upward flow of fluid. Preferred operation of the apparatus prescribes the processing of presized material. Empirical formulation is set forth for determining the screening size to be employed in adjacent stages of screening utilized in presizing the material.

47 Claims, 9 Drawing Figures

FIG. 6
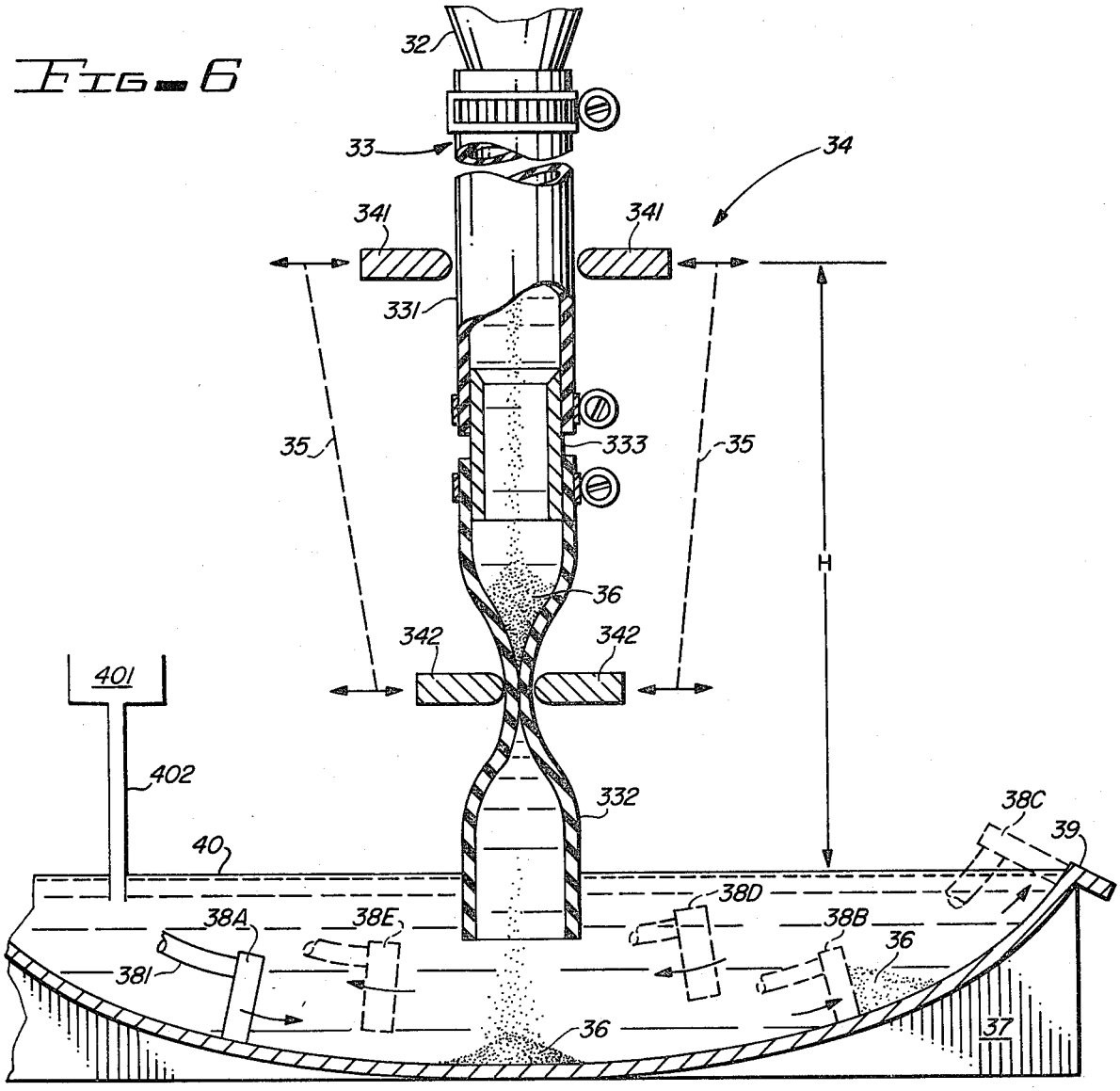
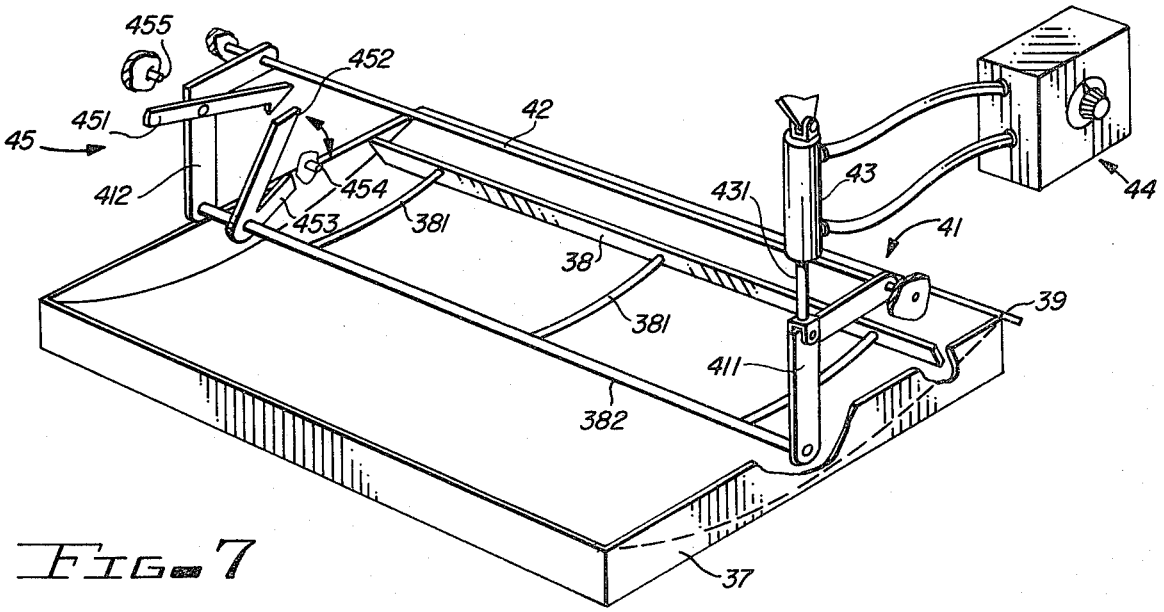
FIG. 7

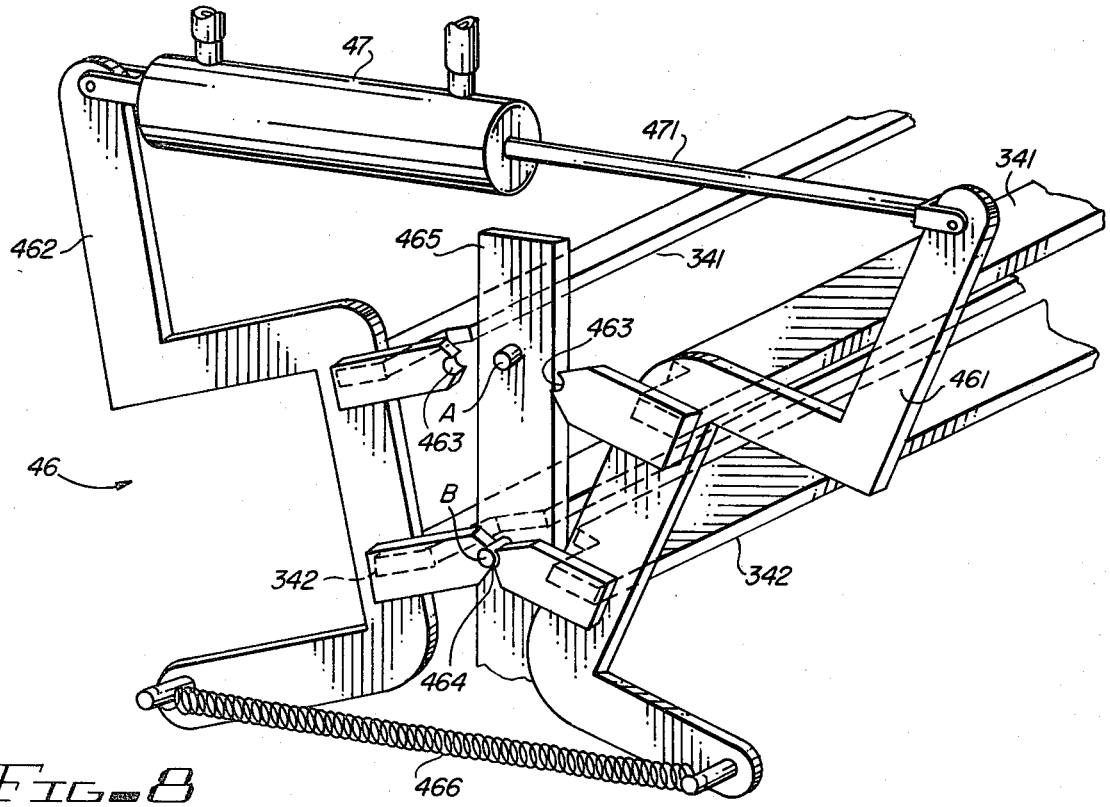
FIG. 8
FIG. 9
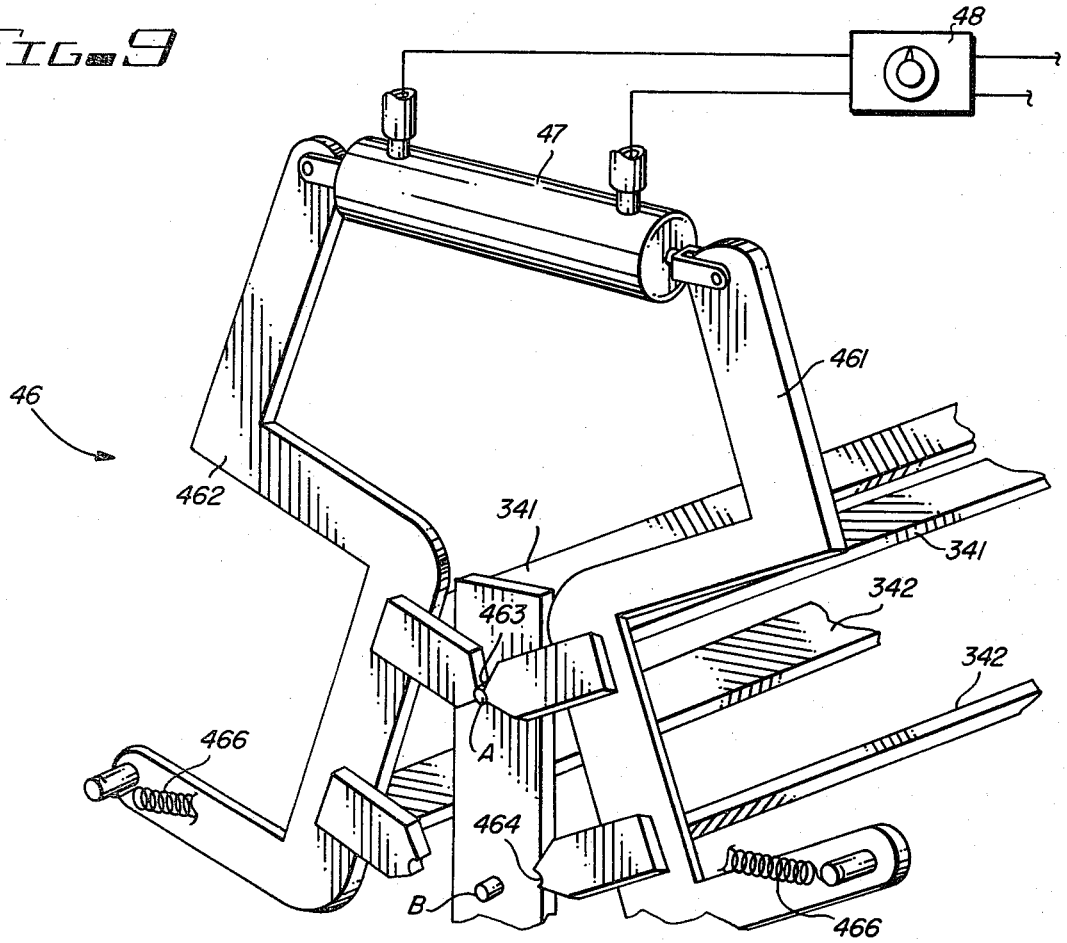

MINERAL SEPARATION BY PARTICLE SETTLING CHARACTERISTICS

DESCRIPTION

1. Technical Field

The invention relates to the mining arts. In particular, the invention relates to the treatment of materials derived from a mining operation for the purpose of separating out the various components making up such material. The invention relates also to the field in which one or more substances are contained within a carrier material and it is desired that such substances be separated from the carrier material and from each other. Most specifically, the invention relates to the separation of substances in accordance with the fluid particle settling characteristics of the particles making up such substances.

2. Background Art

Methods and devices utilizing water for the separation of one or more substances from another are well known in the prior art. Certain U.S. Letters Patent are familiar to the inventor and are set out hereinafter to establish the background environment.

On Nov. 12, 1878, Allen received U.S. Pat. No. 209,789 for a riffled trough down which water flows and carries materials, the heavier of which drops in openings placed between the riffles. Later improvements included the use of a pulsating water flow. Typical of devices utilizing such pulsating flow are the patents granted to Card, U.S. Pat. No. 372,741 on Nov. 8, 1889; to Richards, U.S. Pat. No. 1,176,403 on Mar. 21, 1916; and to Reap, U.S. Pat. No. 1,217,826 on Feb. 27, 1917.

Dickson, in U.S. Pat. No. 1,984,362 issued Dec. 18, 1934, makes use of a moving rake or helix or the like to aid in separation of the materials. Pardee, in U.S. Pat. No. 2,287,748 issued June 23, 1942, makes use of the moving rake or helix and supplements the same with a pulsating water flow.

Elder, in U.S. Pat. No. 1,490,420 issued Apr. 15, 1924, directs his innovative efforts towards the separation of flour-type minerals. These are very fine substances and are hard to separate from the containing material. The invention consists essentially of a pulp pool in which the heavier materials are allowed to separate slowly and be drawn downward by gravity. Constant, in U.S. Pat. No. 2,212,467 issued Aug. 20, 1940, makes use of a shaker screen within the pulp pool while Marston, in U.S. Pat. No. 2,714,956 issued Aug. 9, 1955, utilizes a vertically oscillating trough or pool bottom.

Coal cleaning and separation apparatus are disclosed by Prins in U.S. Pat. No. 2,246,532 issued June 24, 1941. The Prins apparatus may well be considered an improvement on that of Allen noted earlier. Coal and waste material are subjected to a rapidly moving, essentially horizontal flowing stream of water. As the material flows along the horizontal stream, the lighter coal tends to move to the top while the heavier waste materials move to the bottom. An opening is emplaced in the trough along which the material is moving and the water propels the material at a sufficient velocity to enable the lighter coal particles to jump across the gap emplaced in the trough bottom while the heavier waste materials drop through the trough opening to be collected and disposed of.

On Dec. 12, 1922 a patent, No. 1,438,537, was issued to Lioud for apparatus for the separation of coke or carbon from slag or the like. Lioud provides apparatus requiring the use of a horizontal flow of water to move desirable materials from the input to the output of the device. He supplements the horizontal fluid flow with a vertical flow of water which is injected into the horizontal stream through an orifice of essentially zero transit length. Several such upward flowing streams of water are utilized, each capable of fluidly communicating with the other since these streams are not isolated one from the other. It is intended that waste material will fall down through the zero transit length orifices against the upwelling flow. To further segregate the heavier waste material by size, Lioud provides an embodiment which includes means for controlling the size of the zero transit length orifices. Lioud's teaching stresses the need for the horizontal stream of water to constantly flow along the length of his apparatus.

Robertson, in U.S. Pat. No. 2,325,881 issued Aug. 3, 1943, discloses recovery apparatus in an embodiment adapted for recovering fine gold from sand. Robertson provides a trough with V-shaped longitudinal grooves along its bottom. Several separating stations are disposed along the length of the trough. Each separating station consists of a transverse row of upright ducts, or tubes, opening into the bottom of the triangular shaped grooves. Water flows upward through these tubes into the trough. Each water flow is maintained independent of the water flow in adjacent tubes. Material is introduced into the trough by a horizontal movement of water introduced into the gold bearing sand at the input to the trough. The horizontal flow of water is continued through and along the length of the trough as a result of the continuing supply of water at each separating station. A riffle plate is emplaced immediately downstream of each separating station. Robertson sees the provision of a group of small tubes providing for an upwelling flow of water at each separating station as the important feature of his invention. He notes that if a single large counterflow tube were employed, to which a relatively large column of water flowed, there would be eddy currents set up in the tube that would destroy the uniformity of the counterflow and allow other material to fall through these tubes in addition to the desired gold. Robertson states, "This eddy current problem is one of the principle reasons why counterflow systems have not been successful for recovering fine gold."

All of the systems of the prior art known to the inventor place strong emphasis on separating of particle substances by the density of the particles. Thus, such prior art devices frequently require the use of horizontal flowing streams which will carry desired materials over and across openings down which dense materials will fall. No prior art inventions are known to the inventor which utilize an essentially quiescent horizontal component of fluid flow and subject the particles solely to a uni-directional, upwelling flow of water to achieve particle separation in accordance with the fluid settling characteristics of such particles.

In working with fluids, there are eight fluid forces which must be considered. These are:

inertia force (mass)(acceleration)
viscous force (viscous shear stress)(shear area)
gravity force (mass)(acceleration due to gravity)
pressure force (pressure)(area)
centrifugal force (mass)(acceleration)
elastic force (modulus of elasticity)(area)
surface-tension force (surface tension)(length)

vibratory force (mass)(acceleration)

In the flow of fluids around objects and in the motion of bodies immersed in fluids, vibration may occur because of the formation of a wake caused by alternate shedding of eddies in a periodic fashion or by the vibration of the object or the body. In the derivation of the embodiment of the invention disclosed herein, vibratory forces were considered to be absent or to have such little effect as to be negligible in effecting the settling characteristics of the particles in question. In the design of the apparatus, the particles have been considered to be completely immersed in incompressible fluids. In such situations, the gravity force, although acting, does not affect the flow pattern. Since we are not concerned with rotating machinery, centrifugal forces are absent. By definition of an incompressible fluid, elastic forces are zero, and since the particles are totally immersed, there is no liquid-gas interface and thus, surface-tension forces are absent.

The only forces thus to be considered in deriving apparatus for separating substances in accordance with the settling characteristics of substance particles are the inertia, viscous, and pressure forces. Using standard numbers, i.e., dimensionless numbers ratioed against the inertia force, the parameters to be considered are Reynolds number and pressure coefficient. The Reynolds number is the ratio of inertia to viscous force. The pressure coeffficient is the ratio of inertia to pressure force. The Reynolds number may be converted into a kinematic ratio. In this form, the Reynolds number is the ratio of the fluid velocity and the shear velocity. For this reason, the Reynolds number is used to characterize the velocity profile. The pressure coefficient may then be utilized to determine forces and pressure losses.

A less exact way of considering particle settling characteristics would analogize settling characteristics to buoyancy. Thus, a particle tending to settle slowly might be considered more buoyant than a particle which settles rapidly. Buoyancy is determined by the upward pressure exerted by the fluid upon the particle. When this upward pressure, which in itself is determined by the volume and cross-sectional area of the particle, is equal to the weight of the fluid displaced, the particle is truly buoyant and will float. When the volume of the particle and its cross-sectional area result in an upward pressure force being exerted on the particle when is less than the weight of the fluid displaced, the particle will exhibit negative buoyancy and will move downward through the fluid. When two particles of unequal size display the same settling characteristics, that is, equivalent values of negative buoyancy, the ratio of particle weight to fluid volume displaced for each such particle will be equal. Thus, in material in which there are mixed particles having similar settling rates, the larger particles will be less dense than the smaller particles. Apparatus which segregates particles of unequal size in accord with their settling characteristics will thus segregate the material into groupings, a screening of which will result in further segregation in accord with substance type.

If the material is first pre-sized so that the range of particle size is limited, apparatus which segregates particles in accordance with their fluid settling characteristics will satisfactorily segregate such particles in accordance with the substances contained in the materials introduced into the apparatus.

It is therefore an objective of the invention to provide apparatus for segregating substances in accordance with their fluid settling characteristics.

It is a further objective of the invention to subject material substances primarily to upwelling fluid flows with minimal horizontal fluid flow pressures being brought to bear on the particles.

It is another objective of the invention to utilize essentially only gravitational forces to draw the particles to an upwelling flow of fluid and to restrain material as it passes through a region of relatively high fluid pressure flow so as to extend the effective period of time said upwelling fluid flow may interact with said particles for purposes of segregating particles in accordance with their fluid settling characteristics.

An additional objective of the invention is to provide apparatus having a multiplicity of upwelling fluid flows, each of which upwelling flows is independent one from the other such that particles traversing the apparatus will not be subjected to the effects of one or more upwelling flow interacting with another.

It is a specific objective of the invention to provide means for collecting materials segregated in accordance with their fluid settling characteristics and for recovering substances so collected in a manner which will not interfere with the operation of the apparatus or modulate the upwelling fluid flows therein.

DISCLOSURE OF THE INVENTION

The invention comprises apparatus for separating substances contained within carrier materials. The carrier materials are passed to an upwelling flow of fluid wherein desired substances move counter to the upwelling flow to a first collection means and undesired materials move along said upwelling fluid flow to a second collection means. In the context of this disclosure, "desired" materials are those which the user of the apparatus desires to segregate in the first collection means after their movement counter to the upwelling flow. "Undesired" materials are those which are collected in the second collection means after moving along with the upwelling fluid flow. In this context, the terms "desired" and "undesired" imply nothing as to the intrinsic worth of the materials so segregated. The improvements in such apparatus disclosed herein comprise a winnowing channel of finite length through which desired materials must overcome a sustained region of relatively high pressure fluid flow in order to move counter thereto. The winnowing channel has retardation means therein for retarding the counter movement of such materials as enter within the upwelling fluid flow to increase the effective interaction time of the fluid flow on such materials. In the embodiment disclosed, the retardation means comprises a surface of the winnowing channel canted from the horizontal by an angle essentially equal to the repose angle of such material when exposed to the relatively high pressure fluid flow.

Flow channel means are coupled to the winnowing channel to channel the upwelling fluid flow to the winnowing channel. The flow channel means have further means therein for increasing the pressure of the upwelling fluid flow to provide for the sustained region of relatively high pressure fluid flow within the winnowing channel.

The first collection means are coupled to the winnowing channel downstream of the upwelling fluid flow for collecting material which has moved through the winnowing channel. In the embodiment disclosed, the first collection means comprises flexible walled conduit. Fluidly coupled to the flexible walled conduit is a fluid containing vessel which comprises the recovery means for recovering material from said collection means.

Means are provided for isolating the upwelling fluid flow from said recovery means while material is being recovered from the first collection means. In the embodiment disclosed, the fluid isolation means comprises a pair of crimping bars for crimping the flexible walled conduit of the collection means. Operation of the crimping bars is such that each pair of crimping bars must crimp the flexible wall of the collection means before either pair is allowed to permit the section of flexible wall under its control to un-crimp.

Material is passed to the upwelling flow of fluid by a downward sloping surface. No horizontal flow of fluid across this surface is provided. Rather, the materials deposited on said downward sloping surfaces will be drawn by gravity toward said upwelling fluid flow. To this end, in the embodiment disclosed, the downward sloping surface is established at an angle below the horizontal approximately equivalent to the quiescent repose angle of the material being processed.

A fluid retainment vessel is provided for accumulating a sufficient volume of fluid from the upwelling fluid flow to totally immerse the material to be processed as said material is passed by the downward sloping surface to the upwelling flow of fluid. Material agitation means are fluidly coupled to the fluid accumulated in the fluid retainment vessel so that materials to be processed may be introduced to the fluid accumulated in said fluid retainment vessel in a controlled manner with minimal agitation of said accumulated fluid. No fluid is provided to the fluid retainment vessel or to the material agitation means other than that fluid which accumulates in that vessel by reason of the upwelling flow of fluid.

Means are provided for passing off fluid from said upwelling flow, which fluid is in excess of that accumulated in said fluid retainment vessel such that material which is borne upward by said upwelling flow is passed off with said excess fluid. Means are provided immersing the downward sloping surface to a sufficient depth within the fluid accumulated in the fluid retainment vessel so as to minimize fluid flow across the downward sloping surface. In the embodiment of the invention which comprises a plurality of downward sloping surfaces and a plurality of winnowing channels, each of which winnowing channels receives material passed to it by one of said plurality of downward sloping surfaces, fluid flow across said downward sloping surfaces is minimized by increasing the depth of immersion of each said downward sloping surface in direct proportion to the proximity of said downward sloping surfaces to the means for passing off fluid from said upwelling flow. That is, the closer said downward sloping surface is to said means for passing off fluid, the deeper said downward sloping surface is immersed within the fluid accumulated in the fluid retainment vessel.

In the event that desired material entering the upwelling flow from a downward sloping surface may initially move in a direction which would cause it to pass the entry of a winnowing channel, interception means are provided to intercept such particles so as to momentarily restrain them and permit them to thereafter move counter to the upwelling fluid flow through said winnowing channel to be recovered from the said first collection means. In the embodiment of the invention disclosed, the winnowing channel has a finite length. This finite length is important in that it contributes to better initial separation of the desired and undesired materials. There is no communication between or among fluid flow channels and thus, modulation of the upward flow of fluid in any individual flow channel will have no effect on the upwelling flow of fluid in other flow channels of the apparatus. The use of material repose angles within the winnowing channel and the downward sloping surfaces provides for steady, controlled movement of material without build-up or avalanche problems which could cause the injection of undesired materials downward into said first collection means.

BRIEF DESCRIPTION OF THE DRAWINGS

FIG. 6 is a side elevation detail of the first collection means of the mineral separation apparatus illustrating also the recovery means and the fluid isolation means which enables recovery of desirable materials from said first collection means without interfering with operation of the mineral separation apparatus or modulation of the upwelling fluid flow therein.

FIG. 7 is a perspective view of the recovery means and the sweeper bar apparatus which provides for removal of the recovered materials from the recovery means.

FIGS. 8 and 9 are perspective views illustrating details of the operative linkages for exercising the crimping bars which comprise the fluid isolation means.

BEST MODE FOR CARRYING OUT THE INVENTION

Figure 1:
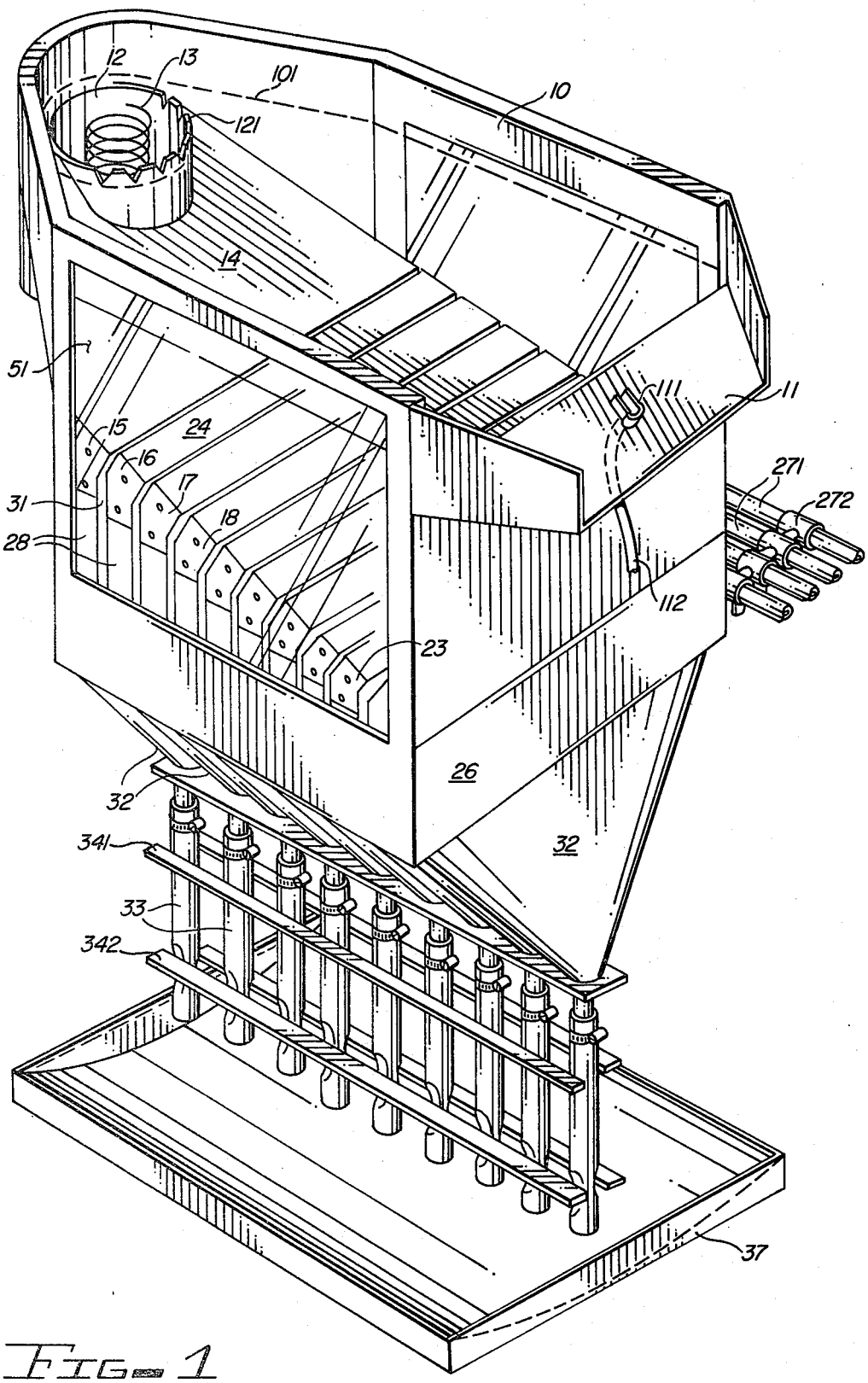
FIG. 1 is a perspective drawing of the apparatus comprising the mineral separator for separating substances in accordance with particle fluid-settling characteristics.

The embodiment of the invention presently conceived as engendering the best mode for carrying out the invention is depicted in FIG. 1. A fluid retainment vessel 10 can accumulate fluid to the level indicated by dashed line 101. Further accumulation of fluid is prevented by overflow trough 11 from which excess fluid is passed off. Material bearing substances which are desired to be segregated from the carrying material is deposited in the material agitator compartment 12. A rotary agitator 13 provides the means for agitating material so deposited. Material agitator compartment 12 is fluidly coupled to the fluid accumulated in vessel 10 by depressions 121 in the wall of agitator compartment 12. Depressions 121 permit fluid from vessel 10 to enter into agitator compartment 12 and thoroughly immerse material deposited therein. Agitator 13 then agitates the immersed material in a manner which permits it to overflow agitator compartment 12 and be deposited in vessel 10 in a controlled manner with minimal agitation of the fluid in vessel 10.

Figure 2:
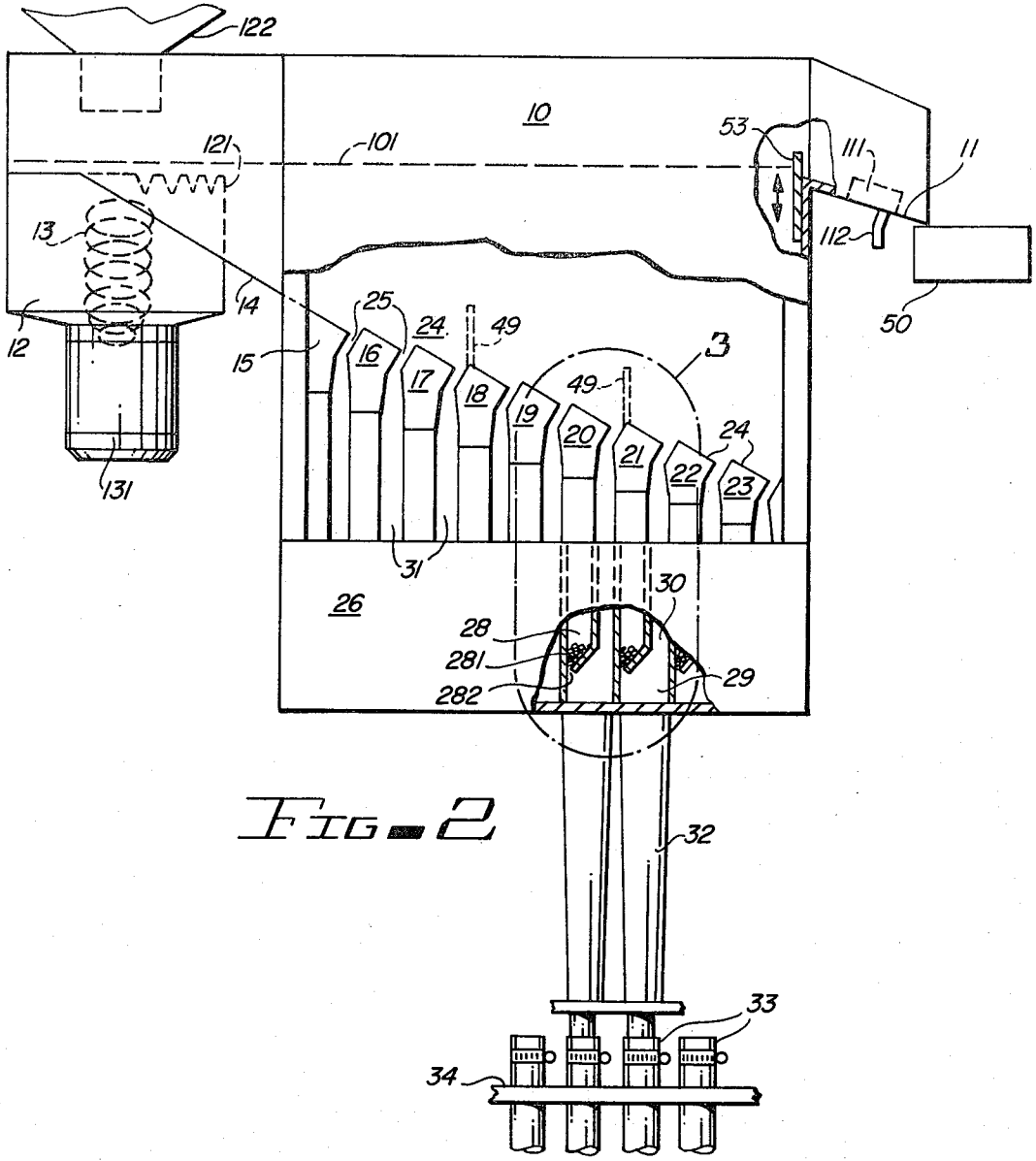
FIG. 2 is a side elevation of the mineral separator.

As best seen in FIG. 2, agitator 13 is provided with a drive means such as motor 131. Reference may be advantageously made to FIGS. 1, 2 and 3 in the course of the following discussion.

A downward sloping surface 14 is coupled to agitator compartment 12 to accept the materials introduced into vessel 10 by the action of agitator 13. In the preferred embodiment of the invention, surface 14 is inclined below the horizontal at an angle approximately equivalent to the quiescent repose angle of the material deposited thereon. The repose angle is that angle at which material will move downward across surface 14 solely under the influence of gravity without accumulating thereon or avalanching across its surface. The quiescent repose angle is the repose angle of such material immersed in quiescent fluid, that is, fluid which does not flow downward across surface 14 to supplement the gravity imposed movement of such materials.

Vertical structures 15 through 23, each having an upper surface 24 downwardly inclined at the quiescent reposed angle of the materials being processed, are arranged so as to provide fluid flow channels 31 and winnowing channels 25.

Winnowing channels 25 are utilized (a) to separate out or eliminate the undesired part or parts of material; and (b) to extract or select the desired part or parts of the material. This winnowing action is achieved by providing an upwelling fluid flow through flow channels 31.

Figure 3:
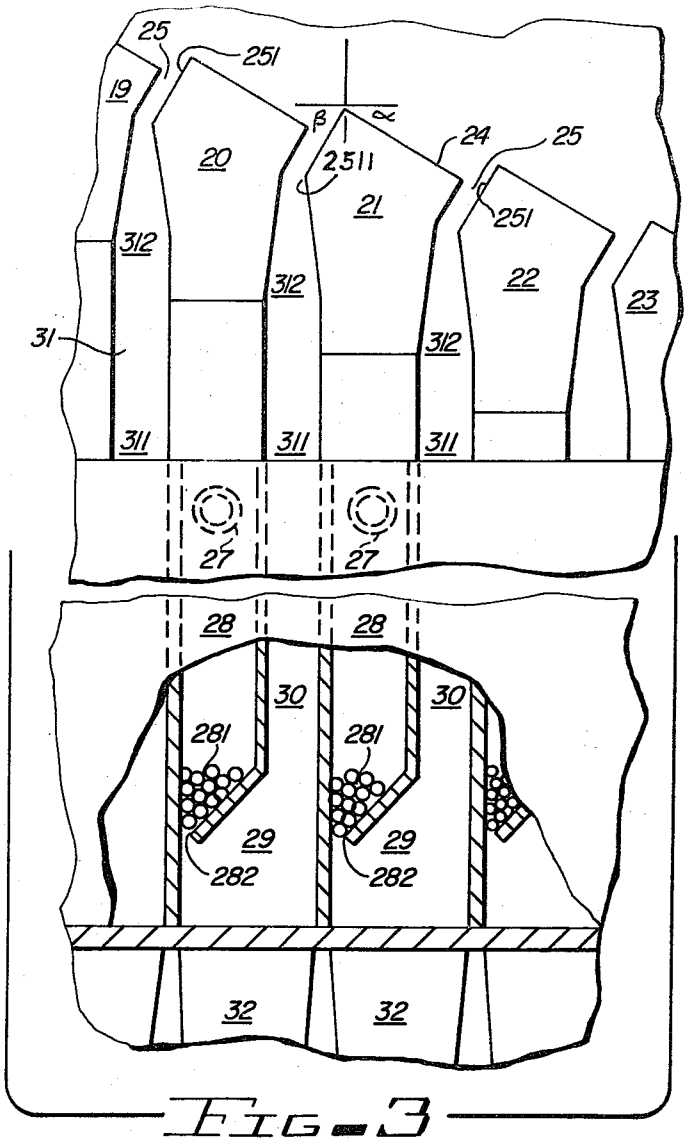
FIG. 3 is a detail of a portion of FIG. 2 illustrating the fluid flow channel, winnowing channel and repose angle surfaces as well as the means for initiating a uniform sheeted upwelling flow of fluid in said flow channels.

The manner in which the upwelling fluid flow is achieved is best illustrated in the detail of FIG. 3. Each fluid flow channel is supplied fluid by a fluid inlet port 27. As best seen in FIG. 1, each fluid inlet port is coupled to a fluid source by piping 271, the flow from each inlet port 27 being controlled by fluid control valves 272. To provide for a uniform sheeted flow of fluid upward through channel 31, fluid from inlets 27 enters fluid input compartment 28 from whence it is diffused by shot 281 and exits via elongate sheeting-flow orifice 282 to enter fluid flow reservoir 29 in the mid section 26 of the invention. Shot 281 disperses the fluid uniformly along elongate orifice 282. Fluid thus emerges from elongate slot 282 as a uniform sheet of fluid which provides an essentially laminar upwelling flow of fluid to reach winnowing channels 25.

The fluid flows upward from fluid flow reservoir 29 increasing somewhat in velocity as it enters lower fluid flow channel 30 in mid section 26. The fluid moves upward to upper flow channel 31 which is defined in the detail of FIG. 3 as being comprised of flow channel 311 and acceleration channel 312.

In acceleration channel 312, the walls defining upper channel 31 are drawn to closer proximity to increase the velocity and the pressure of the fluid as it wells upward into winnowing channel 25.

Winnowing channel 25 is a rectilinear channel of finite length. Wall 251 of winnowing channel 25 provides means for retarding material entering the winnowing channel 25 so as to increase the effective interaction time in which the relatively high velocity flow of fluid will act on particles entering the upwelling flow from downward sloping surfaces 14 and 24. Surface 251 of winnowing channel 25 is inclined below the horizontal at the repose angle of the material when the material is subjected to the relatively high pressure flow of fluid through winnowing channel 25. A portion of surface 251 rises above the point at which material is deposited from downward sloping surfaces 14 and 24 to provide the means for intercepting materials having settling characteristics which would permit them to flow counter to the upwelling fluid flow but which are initially impelled slightly upward upon entry into the upwelling flow.

Material having settling characteristics which permit said material to traverse surface 251 in a direction counter to the upwelling fluid flow will be deposited in the central region of upper flow channel 31 from whence it will settle downward through lower flow channel 30 and fluid flow reservoir 29 into collection troughs 32, which in the embodiment disclosed, are semi-rectangular funnel shaped troughs. Collection troughs 32 funnel the settling material to collection means 33 which will be discussed in greater detail hereinafter.

In practice, material containing several substances which are desired to be segregated one from the other, is deposited, for example by means of input funnel 122, in material agitator compartment 12. Compartment 12 is filled with fluid from vessel 10, which fluid is that accumulated in vessel 10 from the fluid upwelling through winnowing channels 25. Surfaces 24 are immersed progressively lower in the fluid accumulated in vessel 10 the closer such surfaces approach overflow trough 11. This arrangement inhibits the flow of fluid downward across surfaces 14 and 24 so that the fluid at these surfaces is essentially quiescent and material moving along such surfaces does so primarily under the influence of gravitational forces.

Under the action of agitator 13, material in compartment 12 is eased upwards and through depressions 121 in compartment 12 from whence it enters the fluid accumulated within vessel 10. This material settles upon downward sloping surface 14. With the downward slope of surface 14 established at the quiescent repose angle of the material, the material will move uniformly without tendency to accumulate or avalanche. This downward movement will bring the material to the first of the winnowing channels 25.

For the most effective separation action of the substances making up the material to be processed by the invention, it is suggested that the material be presized by screening, or equivalent process, so that the particles making up the material are relatively uniform in size. To determine adjacent size groupings of such presized materials, an empirical formulation has been derived. Thus, to determine the mesh size of the screening to be used in adjacent stages of screening, the formula is $$M_2/M_1=(G/g)(K),$$

wherein $M_2$ is the large mesh size of an early stage of screening and $M_1$ is the smaller mesh size of the next adjacent stage of screening and G/g is the ratio of specific gravities of the two most dense substances carried by the material to be processed. G being the specific gravity of the denser of the two substances and g being the specific gravity of the lesser dense substance. K is a constant, determined empirically, which permits the particle having the greater specific gravity to move counter to the upwelling fluid flow while the particle having the lighter specific gravity moves along that upwelling flow. Where the geometric shapes of the particles making up the two substances are similar, a nominal value of 0.7 for K has proven satisfactory and concentrate purity of materials collected in collection means 33 of 98% have been achieved with a total recovery of 99% of the substance originally contained within the carrier material.

If the material is not presized, the material collected in collection means 33 will be a mix of particles having similar settling rates. The larger particles will be less dense than the smaller particles. Thus, a screening of the collected materials at this time will generally suffice to separate the substances comprising the mix of particles.

Since the preferred mode of operation of the invention envisions presizing of material, the description of the invention will proceed on that premise.

As earlier noted, downward sloping surface 14 is at the repose angle of the material to be processed and material deposited on surface 14 will move downward under the influence of gravity in a gradual, regularly progressive manner without avalanche. As the material reaches the first of winnowing channels 25, the material particles move from the support of downward sloping surface 14 and are subjected to the relatively high pressure fluid flow upwelling from winnowing channel 25. Certain constituent substances of the material will move downward counter to the upwelling flow to be drawn by gravity to surface 251 of winnowing channel 25. Other constituent substances will be borne upward along the upwelling fluid flow to be carried along a boundary flow layer to overflow trough 11. Material borne by the upwelling flow to trough 11 is deposited in collection means 50 from whence it may be recovered for further processing or disposal as necessary. Since the velocity and pressure of the upwelling flow through winnowing channel 25 affects the Reynolds number or velocity profile, of the particles subjected to the upwelling flow, the velocity and pressure of the upwelling flow may be controlled by adjustment of control valves 272. If the velocity is too low, the Reynolds number will be too small to permit proper segregation of the constituent substances of the material and a high proportion of undesired material will move downward counter to the upwelling flow. If the velocity of the upwelling flow is too high, the Reynolds number will be so large as to preclude the settling of much of the desired materials and these will be borne upward along the upwelling flow to exit via overflow trough 11. When the velocity of the upwelling flow is properly adjusted, a high purity concentrate will be collected in collection means 33 having little or no undesirable materials therein and an extremely small percentage of desired materials will find their way upward to overflow channel 11.

Transparent window 51 is provided in the side of fluid retainment vessel 10 so that the interaction of material with the upwelling flow of fluid through winnowing channels 25 may be observed while fluid control valves 272 are adjusted. As a further aid to the adjustment of fluid flow velocity, sampling trough 111 is provided as part of overflow trough 11. Sampling trough 111 permits a sample of the overflow fluid and its material content to be drawn off through tubing 112 so that a determination may be made of the amount of material being borne upward on the upwelling flow which material is desired in practice to move counter to said upwelling flow and be collected within collection means 33. The velocity of the upwelling fluid flow through winnowing channels 25 is adjusted by means of fluid control valves 272 so as to minimize the quantity of desired materials appearing at sampling trough 111.

With fluid flow through winnowing channels 25 optimally adjusted, material advancing downward along surface 14 will encounter the upwelling flow at the first of winnowing channels 25. Separation of the material into its constituent substances is initiated at this point. Particles of desirable materials will tend to move counter to the upwelling flow while undesired materials will be borne upward along with that flow. Certain desirable particles however, because of their configuration and the manner in which they enter the upwelling flow, will initially tend to be borne upward along that upwelling flow. A relatively large percentage of the desired particles initially borne upward will be intercepted by that portion of surface 251 of winnowing channel 25 which rises above the point at which the particles enter the upwelling flow from downward sloping surface 14. Particles so intercepted, as well as particles which initially enter the upwelling stream and move counter thereto, will be restrained in their counter movement by contact with surface 251 of winnowing channel 25. Incline surface 251 is at the repose angle of material subjected to the upwelling flow of fluid. By intercepting these particles on surface 251 and restraining their downward movement, the effective reaction time of the upwelling flow on these particles is extended. The effect of this extension of the interaction time of the upwelling flow of fluid with the particles provides a more effective separation action since undesired materials which may initially be carried downward counter to the upwelling flow will be subjected for a longer period of time to the effect of a high velocity fluid flow tending to dislodge them from their contact with surface 251 and bear them upward with the upwelling flow. It is for this purpose that winnowing channel 25 has a finite length. Prior art devices using upwelling fluid flows for separation of material substances are known to employ fluid orifices of essentially zero length. Undesired material passing such a zero length orifice immediately enters a region of reduced fluid velocity and pressure and will thereafter frequently continue its counter movement and thus contaminate the product desired to be collected. In general, and by way of example, it has been found desirable to provide the winnowing channel with a length of at least 63.5 mm (one-quarter inch).

Further opportunity for separation of the constituent substances of the material is presented when the material moves downward off surface 251 and enters the approximate center of the relatively high velocity upwelling fluid flow. Here the particles are no longer in contact with surface 251 and no restraint is placed on the interaction of the particle with the upwelling fluid flow. Undesired materials which, because of their shape or contact with desired material particles, have traversed incline surface 251 and entered the acceleration channel 312 at the approximate center of the upwelling flow are now fully exposed to the upwelling movement of the fluid and will be borne upward through winnowing channel 25 and out into the fluid accumulated within vessel 10 until deposited by that fluid movement on overflow trough 11 to be collected in collection means 50. The potential for further separation persists as the particles move downward through upper flow channel 31 and lower flow channel 30. Below fluid input reservoir 29, the fluid contained in collection troughs 32 and collection means 33 becomes quiescent and the particles which are successfully moved counter to the upwelling fluid flow settle downward into collection means 33.

Certain of the desired particles moving downward across sloping surface 14 to encounter the fluid flow upwelling from the first of channels 25 will, because of their configuration and the aspect with which they enter the upwelling fluid flow, be initially borne upward along that fluid flow to such an extent as to avoid interception by that portion of surface 251 of winnowing channel 25 which extends above the point at which the particles are injected into the upwelling flow from downward sloping surface 14. The fluid settling characteristics of these particles will preclude their being borne upward to overflow trough 11 and they will move downward through the fluid accumulated in vessel 10 counter to the upwelling flow until contact is made with one of the plurality of adjacent downward sloping surfaces 24. Since each of surfaces 24 is at the quiescent repose angle of the material, the material particle will move downward across surface 24 under the influence of gravity to again encounter an upwelling fluid flow from the winnowing channel 25 associated with that particular downward sloping surface 24. Proper adjustment of the velocity of the fluid flowing through this winnowing channel 25 by means of control valve 272 will provide the particle with the proper velocity profile, Reynolds number, to permit it to move downward counter to the upwelling fluid flow and be collected in collection means 33.

In practice, it has been found that most of the desired materials will be collected by means of the winnowing channels in closest proximity to downward sloping surface 14. Bearing this in mind, it is possible to adjust the velocity of fluid flow in each winnowing channel 25 so as to provide for the collection of two or more desired substances each segregated one from the other within the individual collection means 33.

As an aid in segregating two or more desired materials into individual collection means 33, baffle plates 49 extending the full width of fluid retention vessel 10 may be employed to make the most efficient use of a minimum number of winnowing channels 25 in segregating a desired substance from the material introduced into the fluid accumulated within fluid retention vessel 10. Baffle plates 49 are illustrated in phantom outline in FIG. 2. Two baffle plates 49 are shown segregating three winnowing channels 25 to the left of the illustration, three winnowing channels 25 to the right of the illustration and three winnowing channels 25 in the central portion of the figure. Assume that materials carrying lead sulphide, PbS (galena); barium sulphate, $BaSO_4$ (barite); and calcium fluoride, $CaF_2$ (fluorspar). By proper adjustment of fluid control valves 272, the upwelling flow of fluid through the three left-most winnowing channels 25 will prove sufficient to carry undesirable materials upward to overflow trough 11 to be collected in second collection means 50. At the same time, galena having a specific gravity of 7.5 will move counter to the upwelling flow and find their way downward through the three left-most winnowing channels 25. Certain particles of galena, having entered into the upwelling flow with an aspect ratio causing them to be initially lifted by the upwelling flow, will be brought to bear against the first of baffle plates 49. From here they will either move immediately downward counter to the upwelling flow or will remain in contact with the surface of baffle plate 49 until a sufficient number of particles has accumulated to cause a group of particles to free themselves from the surface of baffle plate 49 and move enmasse downward to the winnowing channel 25 immediately below.

Barite, with a specific gravity of 4.5, will initially rise above the three left-most winnowing channels 25 borne on the upwelling flow of fluid from these channels. The barite, however, has settling characteristics different from those of the undesired material and will begin to settle out onto the downward sloping surfaces 24 centrally located between the two baffle plates 49. The same statement is true for the fluorspar which has a specific gravity of 3.18. As the barite and fluorspar settle onto the downward sloping surfaces 24 between the two baffle plates 49, the upwelling fluid flow through central winnowing channels 25 causes the fluorspar to be again lifted with the upwelling flow only to be deposited soon thereafter on the downward sloping surfaces 24 of the right-most section of retaining vessel 10 as illustrated in FIG. 2. In each instance, undesired material, for example calcium carbonate $Ca\ CO_3$ with a specific gravity of 2.5, will always be borne upward to be deposited via overflow trough 11 into second collection means 50.

Just as galena was retained on the surface of the first baffle plate 49, so too will a certain amount of barite be intercepted on the surface of the second baffle plate 49 from whence it will move downward to the third of the central winnowing channels 25. A similar experience is encountered by particles of fluorspar which strike the right-most wall of fluid retention vessel 10.

It should be here emphasized that, even without baffle plates 49, several substances may be segregated in individual collection means 33 by careful control of the velocity of the fluid upwelling through winnowing channels 25.

Figure 4:
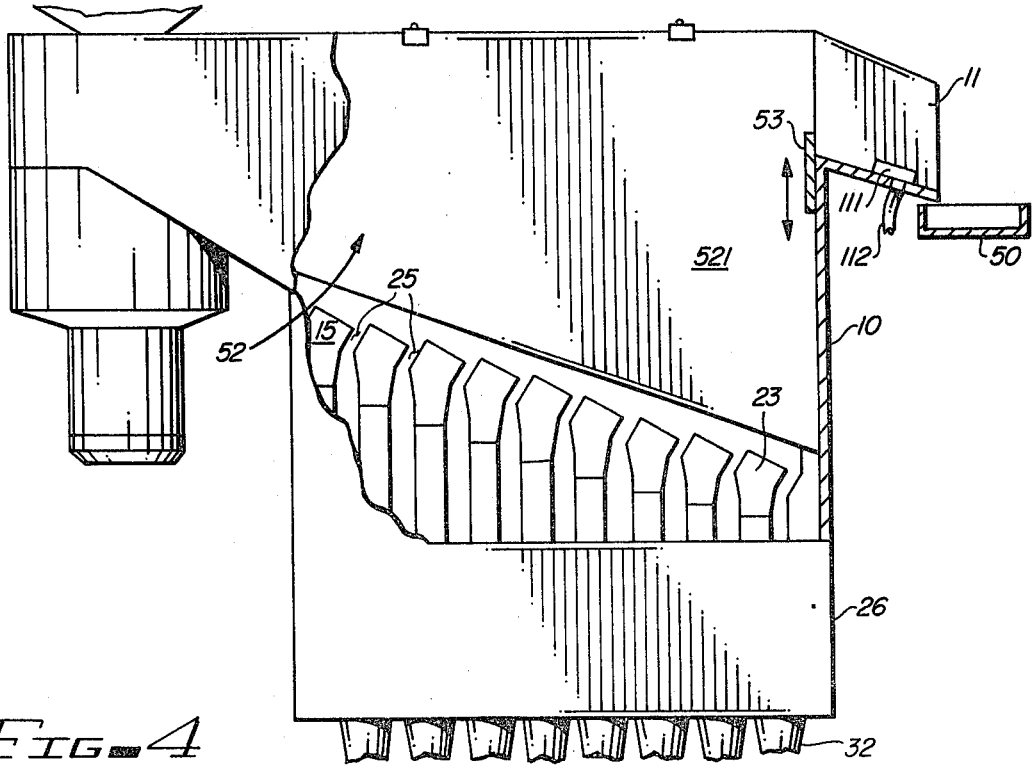
FIG. 4 is a side elevation of the invention showing the installation of fluid displacement plates.
Figure 5:
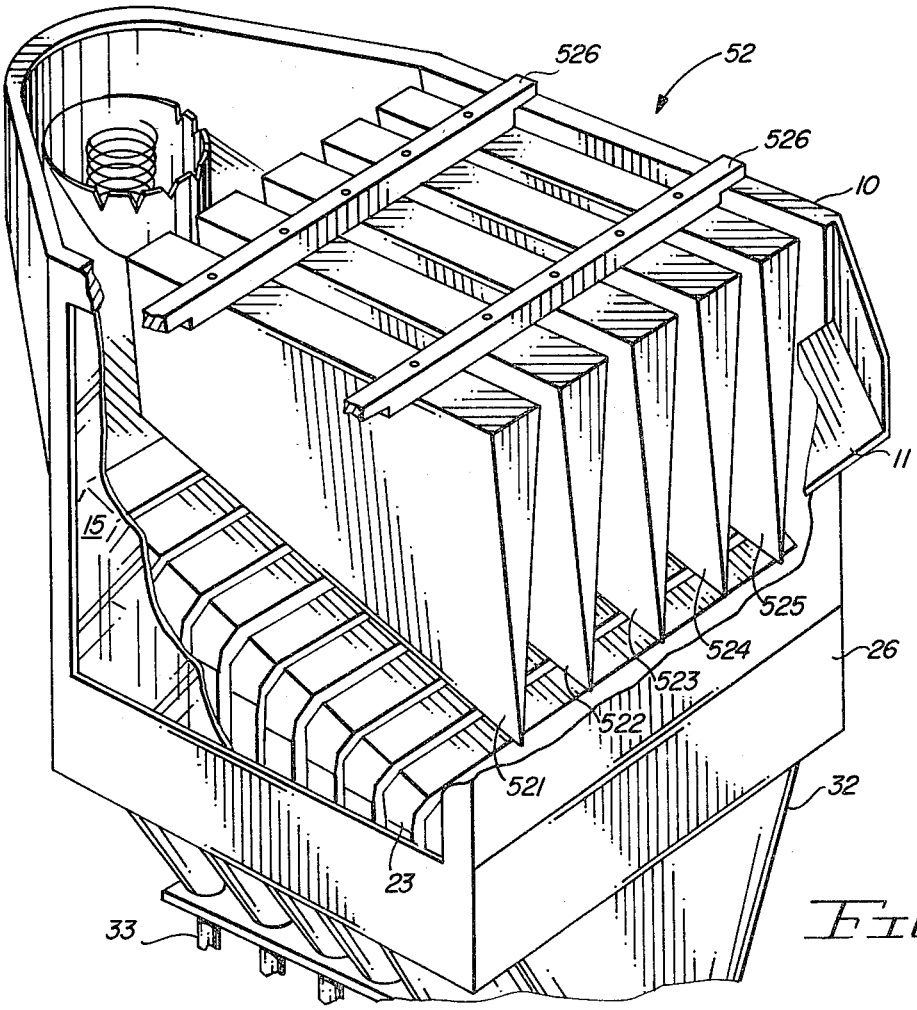
FIG. 5 is a perspective of the installation of FIG. 4.

Often the bearing material will contain substances whose specific gravities are so close to one another in magnitude that it becomes a tedious task to properly adjust the volume of the upwelling flow to permit optimum segregation of these two substances. However, if means 52 are utilized to increase the velocity of the upwelling flow through the accumulated fluid in fluid retainment vessel 10, it becomes significantly easier to separate two substances whose specific gravities are relatively close in magnitude. Means 52 comprise fluid displacement plates 521 through 525. Fluid displacement plates 521 through 525 are coupled to support bracketry 526 which support the fluid displacement plates 521 through 525 within the fluid accumulated within fluid retainment vessel 10 as indicated in FIG. 5. As illustrated in the side elevation of FIG. 4, fluid displacement plates 52 are located just above the plurality of winnowing channels 25 such that particles up-borne by the upwelling flow will be drawn by that flow into the fluid regions between fluid displacement plates 521–525 wherein the upwelling flow is accelerated. Under the influence of this accelerated flow, any tendency for particles originally up-borne by the flow exiting winnowing channels 25 to return downward to sloping surfaces 24 will be overcome by the increased velocity of fluid flowing in the upwelling flow in the regions defined between fluid displacement plates 521–525. In this way, a much more precise separation of substances having close orders of magnitude of specific gravities may be efficiently segregated between collection means 33 and second collection means 50.

The amount of material which may be processed through the mineral separator of the invention will vary with the particulate size of the substances to be recovered. Thus, in a mineral separator in which fluid recovery tank is is a cube of approximately 46 cm. on a side, it is anticipated that three tons of material per hour may be processed if that material comprises particles presized by passage through a 270 mesh screen. If the particles are sized by passage through a 150 mesh screen, approximately six tons per hour may be processed. It is thus seen that a relatively small processing unit can effectively process large quantities of material in reasonably short spans of time. In such a 46 cm. cube fluid retention vessel, winnowing channels 25 will have a width equivalent to that of the vessel 10. By way of example and not of limitation, the height of winnowing channels 25 may be approximately 63.5 mm. For most effective use, the length of the winnowing channel 25 should be approximately 63.5 mm. or more in length since a finite length is required to provide a concentrated region of high fluid velocity through which desired materials must find their way counter to the high velocity flow. In experimental models wherein water was the fluid employed for particulate separation, an angle of 30° below the horizontal for downward sloping surfaces 14 and 24 was found to closely approximate the quiescent repose angle for mineral bearing materials processed by the invention. Under the influence of the upwelling water flow, a slope of 60° below the horizontal for winnowing channel surface 251 provided the proper inclination to permit material to repose on that surface and move smoothly across the surface in response to the influence of gravity without accumulating on the surface or avalanching therefrom.

Attention may now be turned to the manner in which material is collected and recovered in a manner which precludes modulating the upward flow of fluids through winnowing channels 25. Such modulation of fluid flow is undesirable for, if fluid were permitted to flow downward through collection means 33, both fluid and undesired materials would be drawn down through winnowing channels 25 thus contaminating the purity of the materials already segregated in collection means 33. Thus, it is highly desirable to provide means for collecting and recovering materials without so modulating the upward flow of fluid through the winnowing channels 25.

FIG. 6 illustrates collection means 33 in detail. Collection means 33 is shown as a flexible walled tube coupled to collection trough 32. Collection means 33 is shown as comprising an upper flexible wall tube section 331 and a lower flexible walled section 332 coupled together by rigid walled section 333. Section 332 of collection means 33 opens into recovery vessel 37. Recovery vessel 37 is filled with fluid 40 supplied from fluid source 401 via fluid conduit 402. Fluid source 401 is a make-up source of fluid provided to maintain the fluid level within recovery vessel 37. The output end of section 332 of collection means 33 extends below the surface of the fluid contained in recovery vessel 37.

In the illustration of FIG. 6, fluid isolation means 34 comprised of crimp bars 341 and 342 is shown with crimp bars 342 compressing the walls of flexible walled section 332 to preclude passage of particulate material 36 which has successfully moved downward against the upwelling flow from the material deposited in fluid retention vessel 10. Rigid walled section 333 maintains an open passageway so that the action of crimp bars 342 on section 333 of collection means 33 will have no effect on the flexible wall section 331. Collection means 33, as well as collection trough 32 is filled with fluid originally provided when fluid control valves were opened to permit fluid to enter fluid input compartment 28. Fluid contained within flexible section 332 below crimp bars 342 will be retained within that flexible section as a result of air pressure acting upon the surface of the fluid contained within recovery vessel 37.

The operation of fluid isolation means 34 is as follows: with crimp bars 342 compressing the walls of flexible walled section 332, crimp bar motive means, illustrated by dashed lines 35, cause crimp bars 341 to move toward each other so as to compress the flexible walls of section 331. When crimp bars 341 have so compressed the flexible walls of section 331, neither particulate material nor water will be able to pass the point of compression. At this time, crimp bar motive means 35 will cause crimp bars 341 to be maintained in their position while causing crimp bars 342 to move away from each other opening a passageway through flexible walled section 332 through which the accumulated particulate material 36 may move so as to be deposited within recovery vessel 37. No fluid will exit from either flexible walled section 331 or 332 as a result of the opening of crimp bars 342 since the output end of flexible walled section 332 is below the surface of the fluid within recovery vessel 37 and air pressure acting on the surface of the fluid within that vessel will retain the fluid within flexible wall collection means 33. Thus, only particulate material moves out of collection means 33 and the upwelling flow of fluid within the winnowing channels 25 above collection means 33 remains stable and unmodulated.

After a sufficient time has passed for the accumulated particulate material 36 to exit flexible walled section 332 motive means 35 are again operated, this time so as to cause crimp bars 342 to first move together so as to compress the flexible walls of section 332 and then to move crimp bars 341 away from each other so as to release their compressive force on flexible walled section 331 once more permitting the passage of particulate material to accumulate within flexible wall section 332 above crimp bars 342.

Motive mechanism 35 will be disclosed in greater detail hereinafter. Recovery vessel 37 is provided with a sweeper bar 38 coupled to drive rod 381 to move particulate material recovered from recovery means 33 from the fluid within recovery vessel 37. The action of sweeper bar 38 is illustrated sequentially in FIG. 6. Sweeper bar 38A moves from left to right in contact with the bottom surface of recovery vessel 37. In moving beneath collection means 33, sweeper bar 38 pushes the recovered particulate material 36 before it. Sweeper bar 38B is shown in phantom as moving particulate material 36 up the sloping side wall of recovery vessel 37. At the peak of its movement, sweeper 38C deposits the accumulated particulate material onto trough 39 from which it may be manually withdrawn with the aid of such fluid as is pushed over the side wall of recovery vessel 37 by the action of sweeper 38C.

Sweeper 38 then begins its return to the left of the illustration of FIG. 6. In doing so, it is first lifted from contact with the bottom surface of recovery vessel 37 by means which will be illustrated and disclosed in detail in the discussion of FIG. 7. This raised movement of sweeper rod 38D and 38E prevents sweepr bar 38 from drawing any residual particulate materials to the left as it moves back to its initial position. Sweeper bar 38 then returns to the position of sweeper bar 38A in preparation for the next sweep cycle.

An embodiment of a drive mechanism for driving sweeper bar 38 is illustrated in FIG. 7. Sweeper bar 38 is coupled by means of drive rods 381 to pivot rod 382 which provides the means whereby sweeper bar 38 shall be lifted from the surface of recovery vessel 37 on its return excursion after sweeping particulate material 36 to trough 39. Drive linkages 41 transfer the motive force of hydraulic drive cylinder 43 to pivot rod 382 and thus through coupling rods 381 to sweeper bar 38. Drive linkage 41 comprises left and right drive linkages 411 and 412, respectively. In the embodiment herein disclosed, linkages 411 and 412 take the form of a right angle bracket. Hydraulic drive 43 is coupled to the apex of linkage 411. Pivot rod 382 is pivotally coupled to the lower arm of each of linkages 411 and 412. The remaining arm of linkages 411 and 412 is pivotally coupled to and rotatable about fixed shaft 42.

As is readily seen in the illustration of FIG. 7, exercise of hydraulic drive 43 will cause sweeper bar 38 to move across the surface of recovery vessel 37 in a direction depending upon the manner in which hydraulic means 43 is actuated. When piston rod 431 is extended from hydraulic drive 43, sweeper bar 38 is moved across the surface of recovery vessel 37 as linkages 411 and 412 rotate counter clockwise about shaft 42. When hydraulic drive 43 is operative so as to retract piston shaft 431, linkages 411 and 412 will rotate in a clockwise direction about shaft 42 causing sweeper bar 38 to be drawn in a direction away from trough 39.

A latch and pawl means 45 are provided to provide for lifting sweeper bar 38 from the surface of recovery vessel 37 as sweeper bar 38 moves away from trough 39. As sweeper bar 38 completes its movement and deposits particulate material 36 onto trough 39, lifting bar 453, fixedly coupled to pivot rod 382 is brought into contact with pin 454. This causes rod 382 to rotate in a counter clockwise direction so as to lift sweeper bar 38 from the surface of recovery vessel 37. Simultaneously latch 451 engages pawl 452 so as to retain sweeper bar 38 in its position raised above and not contacting the surface of recovery vessel 37. As hydraulic drive 43 retracts piston rod 31 causing linkages 411 and 412 to rotate about shaft 42 in a clockwise direction so as to draw the now raised sweeper bar 38 away from collection trough 39 and back to its initial position, latch 451 will be drawn closer to fixed pin 455. Latch 451 and fixed pin 455 come into contact as sweeper bar 38 is drawn to its fullest extent back from trough 39. Contact between latch 451 and fixed pin 455 causes latch 451 to release its hold on pawl 452 permitting sweeper bar 38 to once more descend so as to contact the bottom surface of recovery vessel 37. Hydraulic controller 44 establishes the timing of the sequence of actions of the sweeper bar 38 cycle.

In FIG. 6, dashed lines 35 were drawn to indicate the existence of motive means for actuating crimp bars 341 and 342. The motive means 35 is made up of crimp bar drive linkages 46 and piston driver 47 illustrated in detail in FIGS. 8 and 9. In the discussion of crimp bar drive linkages 46 and examination of FIGS. 8 and 9, it should be borne in mind that the drive linkages 46 illustrated in FIGS. 8 and 9 are essentially duplicated at each end of crimp bars 341 and 342. Not shown in FIGS. 8 and 9 are the flexible walled sections 331 and 332 of collection means 33. These are omitted here for clarity of exposition of the function of crimp bar drive linkages 46.

Crimp bar drive linkage 46 is comprised of rocking arms 461 and 462 selectively coupled to fixed pins A and B on post 465 by pivot collets 463 and 464. Spring 466 is utilized in maintaining the coupling between pivot collets 463 and 464 and pins A and B. Coupling of hydraulic drive cylinder 47 to rocker bars 461 and 462 completes the linkage assembly 46 and provides the drive means for alternating crimp bars 341 and 342 between states of compression and noncompression of the flexible walled collection means 33.

The status of crimp bar linkages 46 illustrated in FIG. 8 is that shown in FIG. 6 wherein crimp bars 342 compress the flexible walls of section 332 of collection means 33 thus preventing the movement of particulate material 36 downward into recovery vessel 37. Crimp bars 341 will likewise be in the position illustrated in FIG. 6 wherein they exert no compression force upon the flexible walls of section 331 of collection means 33. As shown in FIG. 8, piston rod 471 is fully extended from hydraulic drive cylinder 47. Under these circumstances, pivot collets 464 make intimate contact with pivot post B and are maintained in such intimate contact by the action of spring 466. As hydraulic cylinder 47 is actuated so as to retract piston rod 471, rocker arms 461 and 462 will pivot toward each other about pivot post B until pivot collet 463 is drawn into intimate contact with pivot post A. At this point in the cycle, reference may again be had to FIG. 6 modified in the mind's eye to show both crimp rods 342 and 341 in a state of compressing the flexible walls of sections 331 and 332 of collection means 33. Thus, the fluid below crimp bars 341 is isolated from the upwelling fluid flowing through winnowing channel 25 while, at the same instant of time, the fluid above crimp bars 342 and the particulate material 36 accumulated there are isolated from the fluid in recovery vessel 37.

Continued retraction of piston rod 471 into hydraulic cylinder 47 transfers the rotary pivot point of rocker arms 461 and 462 from pivot post B to pivot post A. As intimate contact is lost between pivot collets 464 and pivot post B, crimp bars 342 are drawn away from flexible walled section 332 of collection means 33 thus providing a channel through section 332 down which particulate material 36 may pass to recovery vessel 37. The condition of crimp bar linkages 46 at this time is shown in FIG. 9. Since the head H of fluid contained within collection means 33 below crimping bars 341 is less than the atmospheric pressure exerted on the surface of the fluid in recovery vessel 37, no fluid will be ejected from collection means 33 when crimp bar 342 are moved to a non-compressing state. As before, spring 466 maintains pivot collets 463 in intimate contact with pivot post A.

It is readily seen from the illustrations of FIGS. 8 and 9 and the foregoing discussion that both sets of crimping bars 341 and 342 must be in a state of compressing the flexible walls of collection means 33 before either pair of crimp bars 341 or 342 release their compressive grip on those flexible walls. In this manner, since no fluid exits from the outlet of flexible section 332 of collection means 33, total isolation of the collection/recovery means is achieved and particulate material 36 may be recovered without interfering or modulating the upwelling flow of fluid through winnowing channels 25.

Hydraulic controller 48 controls the timing of the sequences of the cycle of operation of crimp bar drive linkages 46.

It will, of course, be readily recognized by those skilled in the art that the inclusion of two valves within collection means 33 at the points at which crimp bars 341 and 342 are operative will satisfy the same function of permitting recovery of settling particulate material without modulation of the upwelling flow of fluid through winnowing channels 25. However, such control valves are expensive and have a relatively short useful life since particulate material entering these valves tends to abrade the working surfaces and reduce their effectiveness. The combination of flexible walled conduit for collection means 33 and crimp bars 341 and 342 thus represents the presently preferred embodiment permitting recovery of the settling particular material without modulation of the upwelling flow of fluid.

Since the functioning of the invention is predicated upon segregating materials in accordance with particle settling characteristics, it should prove instructive to restate the interaction of particles with fluid flowing through flow channels 30 and 31 and winnowing channels 25 based on actual observations made in the course of operating the invention. As disclosed, the velocity of fluid passing upwards through winnowing channel 25 is such that only desired particles having the greatest settling characteristics will move freely in a direction counter to the upwelling fluid flow. Certain desired particles which display lesser settling characteristics together with some of the more settleable of the undesired materials will move less readily counter to the upwelling flow or will be rendered momentarily neutral in their movement within that flow. However, due to the fact that winnowing channel 25 has been depressed to the repose angle of the materials subjected to the upwelling flow of fluid, these sluggishly moving or essentially neutral particles, both desired and undesired, under the effect of gravity and fluid forces, will be caused to be deposited against surface 251.

Of the material settling against surface 251, those having the greatest settling characteristics will move closest to the surface displacing those of lesser settling characteristics and exposing this latter group of particles more fully to the upwelling flow of fluid through winnowing channel 25. Two effects are now observed. The material having the lesser settling characteristics being more exposed to the upwelling flow of fluid through winnowing channel 25 is more apt to be displaced upward along that upwelling flow of fluid, while the material displaying the greater settling characteristics, being shielded from the upwelling flow has a tendency to more readily move downward along surface 251 toward acceleration channel 312.

The tendency for material to move more readily counter to the upwelling fluid flow is increased as particles accumulate to a moderate depth upon surface 251. The observed result of such accumulation is an apparent modulating motion of the surface material which proves advantageous in that the very slow moving particles in the lower range of desireability are usually rejected as they reach point 2511 at the juncture of winnowing channel 25 with acceleration channel 312, since, at this juncture, they are fully exposed to the fluid flow and the fluid velocity at point 2511 is essentially the same as that which moves freely through winnowing channel 25.

However, when particles move enmasse past point 2511, they move more rapidly and due to their increased momentum, particles with borderline desirable characteristics may penetrate to a depth within acceleration channel 312 sometimes entering fluid flow channel 311 where the fluid velocity is reduced but is still sufficient to reject undesired material. It is possible that a small portion of the particles at, or very near to, the settling characteristic interface between desired and undesired materials might assume a somewhat neutral condition within the lower portion of acceleration channel 312 and flow channel 311, moving either substantially upward nor downward. Indeed, this condition has been observed in practice and certain of the particles within acceleration channels 312 and flow channel 311 have been observed moving in random manner. This random motion, caused in part by the variable fluid pressures induced by the variable cross-section in flow channel 31 will bring some of the particles in proximity to the lower limits of flow channel 311 from whence they will pass downward through flow channel 20 and into collection means 33. Other particles will be drawn upward through acceleration channels 312 and out along the upwelling flow through winnowing channels 25 to be borne upward to collection trough 11.

The particles capable of such random motion represent only a very small percentage of the whole and it will be understood by those skilled in the art that adjustments may be made to the fluid flow rate to either eject through winnowing channel 25 a very small percentage of desireable material or to accept a very small percentage of undesireable material at first collection means 33. The ejection of a very small percentage of desireable materials through winnowing channel 25 seems to be the more desireable choice in that a separate interface product can be taken at one or more of the final collection means 33. This interface product will contain less than 1% of the total desireable material deposited into material segregation means 12 and total extraction of an essentially pure product would be achieved at the earlier collection means 33.

While those skilled in the art might argue that a proper separation of materials could be achieved using only a vertical channel communicating at its top to a fluid chamber or a cross-flow duct (as taught by Robertson and noted in the background art discussion). While it is true that such a device would be fairly effective for a short time in a case where materials of substantial density differences, e.g. gold in quartz, (specific gravity 16–19 versus 2.5 respectively) are being separated, such a device would be far less effective in materials of close settling characteristics, for the following reasons: turbulence resulting from a cross-flow as it passed the duct with its upwelling flow would cause some undesireable particles, because of their energy of motion, to penetrate deep within such a duct. Many of these particles would continue downward. Such downward passage would result from the fact that a duct of uniform width would have a lower fluid velocity at its side surfaces due to friction and thus, otherwise rejectable particles entering the zone of lowered fluid velocity would fall, along with desireable particles, counter to the upwelling flow. In the invention, such counter movement of undesireable particles is prevented by the shape of the walls of acceleration channel 312 and the proximity of material ejection point 2511.

In the invention, the already substantially separated material, as it emerges at the lower end of winnowing channel 25, passes over point 2511 and, in doing so, is dispersed as individual free-falling particles into the central zone of acceleration channel 312 and moves downward through flow channels 31 and 33 at the central region of these channels away from any retarded flow velocity zones at the boundries of these channels. Thus, the upwelling flow of fluid through channels 30 and 31 remains free to act on nondesireable material and to eject it upward through winnowing channels 25 before it can reach a zone of lower velocity within either of flow channels 30 or 31.

It is thus seen that the combination of a winnowing channel 25 inclined at the material's repose angle outputting material into the central region at the narrow end of a tapering channel, acceleration channel 312, enhances the ability of the upwelling fluid flow to act on and eject undesired material particles.

INDUSTRIAL APPLICABILITY

The apparatus and methods herein disclosed will have general application to processes wherein several substances are sought to be separated and segregated. Since these substances are separated in accordance with their fluid-settling characteristics, it matters not whether such substances are truly mineral substances or not. The method and apparatus set forth for recovering settling substances from a fluid body without unduly disturbing that fluid body will find general application in any field of endeavor employing a fluid settling tank.

What has been disclosed is method and apparatus whereby material immersed in a body of fluid moves under the influence of gravity across inclined surfaces having an angle of incline below the horizontal approximately equivalent to that of the repose angle of the fluid immersed material. Such materials are first moved under the influence of gravity rather than fluid forces to a winnowing channel comprising a closed region of finite length through which an upwelling flow of fluid at relatively high velocity passes into the fluid body in which the material is immersed. Undesired materials pass upward borne on the upwelling flow through the fluid body while desired materials move counter to the upwelling flow passing along a surface at the repose angle of such material within the region of relatively high fluid velocity. Material which successfully traverses the winnowing channel and is not thereafter borne upward on the upwelling flow, settles to a flexible walled collection means. Fluid isolation means capable of compressing the flexible walls of the collection means, permit the recovery of particulate material from said collection means without modulating the upward flow of fluid. Preferred operation of the apparatus prescribes the processing of pre-sized material and empirical formulation is set forth for determining the screening size to be employed in adjacent stages of screening utilized in presizing the material.

Those skilled in the art will derive other embodiments drawn from the teachings herein. To the extent that such embodiments are so drawn, it is intended that such embodiments will fall within the ambit of protection provided by the claims set forth hereinafter.

Having described my invention in the foregoing specification and the drawings accompanying it in such a clear and concise manner that those skilled in the art may readily and easily practice the invention, I claim that which is set forth in the following claims.

I claim:

1. In mineral separation apparatus having means for passing materials bearing minerals and similar substances past an upwelling flow of fluid wherein desired materials move counter to said upwelling flow to first collection means and undesired materials move along said upwelling fluid flow to second collection means, the improvement comprising:

retardation means for retarding the counter movement of such materials as they enter within said upwelling fluid flow to increase the effective interaction time of said fluid flow on such materials as may enter said fluid flow and attempt to move counter thereto; and means for inhibiting the interaction of all said materials with other than an upwelling flow of fluid.

2. The improvement of claim 1 wherein said retardation means comprises a winnowing channel of finite length through which said materials must overcome a sustained region of relatively high pressure fluid flow in order to move counter thereto.

3. The improvement of claim 2 wherein said winnowing channel comprises a surface canted below a horizontal plane such that material entering said winnowing channel will be drawn by gravity to said canted surface and thereby retarded in moving counter to said fluid flow.

4. The improvement of claim 3 wherein said canted surface comprises a wall of said winnowing channel and is canted at an angle approximating the repose angle of said material when subjected to said upwelling fluid flow.

5. The improvement of claim 4 wherein said winnowing channel comprises a rectilinear channel approximately 63.5 mm. (one-quarter inch) in length or larger.

6. The improvement of claim 2 further comprising means for increasing the pressure of said upwelling fluid flow to provide for a sustained region of relatively high pressure fluid flow within said winnowing channel.

7. The improvement of claim 6 further comprising flow channel means for channeling said upwelling fluid flow to said winnowing channel.

8. The improvement of claim 7 wherein the means for increasing the pressure of said upwelling fluid flow comprises constriction means within said flow channel means for increasing the velocity and pressure of said upwelling fluid flow.

9. The improvement of claim 8 further comprising means for introducing fluid into said flow channel means whereby said fluid so introduced upwells through said flow channel means.

10. The improvement of claim 9 further comprising control means coupled to said means for introducing fluid into said flow channel means for controlling the rate at which fluid is so introduced.

11. The improvement of claim 10 further comprising means for providing a uniform fluid flow velocity across said flow channel means.

12. The improvement of claim 11 wherein said means for providing a uniform fluid flow velocity across said flow channel means comprises an elongate sheeting-flow orifice interposed across said flow channel means between said flow channel means and said means for introducing fluid thereto.

13. The improvement of claim 12 further comprising fluid diffusion means interposed between said means for introducing fluid and said elongate sheeting-flow orifice disseminating fluid flow uniformly along said elongate sheeting-flow orifice.

14. The improvement of claim 2 further comprising means for coupling said first collection means to said winnowing channel downstream of said upwelling fluid flow for collecting in said first collection means material moved through said winnowing channel counter to said flow.

15. The improvement of claim 14 further comprising recovery means for recovering material from said first collection means.

16. The improvement of claim 15 further comprising fluid isolation means coupled to said first collection means for isolating said upwelling fluid flow from said recovery means while said material is being recovered from said first collection means.

17. The improvement of claim 16 wherein said fluid isolation means further comprises means for inhibiting the flow of fluid from said first collection means while said material is being recovered therefrom.

18. The improvement of claim 17 wherein said first collection means comprises flexible walled conduit.

19. The improvement of claim 18 wherein said recovery means comprises a fluid containing vessel fluidly coupled to said flexible walled conduit by the fluid contained in said vessel.

20. The improvement of claim 19 wherein said fluid isolation means comprises:

first compressing means for selectably compressing said flexible walled conduit to provide a close region in which said material accumulates without passing to said recovery means;

second compressing means for selectably compressing said flexible walled conduit interposed between said first compressing means and said winnowing channel to provide a closed volume between said first and said second compressing means; and means for alternating said first and said second compressing means between states of compression and non-compression of said flexible walled conduit such that both said first and said second compressing means must simultaneously be in a state of compression of said flexible walled conduit before either of said first and said second compressing means is alternated to a state of non-compression of said flexible walled conduit.

21. The improvement of claim 1 wherein the means for passing materials past an upwelling flow of fluid comprises a downward sloping surface such that material deposited on said surface will be drawn by gravity to said upwelling fluid flow.

22. The improvement of claim 21 wherein said downward sloping surface comprises a smooth surface inclined below a horizontal plane at an angle approximating the quiescent repose angle of said material when immersed in a fluid body.

23. The improvement of claim 21 wherein said retardation means further comprises interception means for intercepting and retarding desirable material entering said upwelling fluid flow from said downward sloping surface which desirable material is initially impelled upward by said upwelling flow.

24. The improvement of claim 23 wherein said interception means comprises an extension of said retardation means above the level at which material enters said upwelling flow from said downward sloping surface.

25. The improvement of claim 21 further comprising:

a plurality of said retardation means; and a plurality of said downward sloping surfaces each cooperatively passing material to a selected one of said plurality of said retardation means via an upwelling flow of fluid.

26. The improvement of claim 25 further comprising means for accumulating a sufficient volume of fluid from the upwelling flow to totally immerse said material as it is passed by said downward sloping surfaces to an upwelling flow of fluid.

27. The improvement of claim 26 wherein said means for accumulating fluid is a fluid retainment vessel having means for introducing material to the fluid accumulated therein.

28. The improvement of claim 27 wherein said means for introducing material comprises material agitation means fluidly coupled to the fluid accumulated in said fluid retainment vessel for introducing material to said accumulated fluid in a controlled manner to inhibit agitation of said accumulated fluid.

29. The improvement of claim 28 further comprising means for coupling a first of said plurality of said downward sloping surfaces to said material agitation means for accepting material introduced into said accumulated fluid and passing it under the influence of gravity to the first of said plurality of said retardation means.

30. The improvement of claim 29 further comprising means for passing off fluid from said upwelling flow which fluid is in excess of that accumulated in said fluid retainment vessel.

31. The improvement of claim 30 wherein said means for passing off excess fluid comprises means for passing off with the excess fluid material borne upward by said upwelling flow.

32. The improvement of claim 31 wherein said means for passing off excess fluid further comprises means for sampling the material content of such excess fluid.

33. The improvement of claim 30 wherein said means for inhibiting the interaction of all said materials with other than an upwelling flow of fluid comprises means for inhibiting fluid flow across said plurality of said downward sloping surfaces.

34. The improvement of claim 33 wherein said means for inhibiting fluid flow across said downward sloping surfaces comprises means for increasing the depth of immersion of each of said plurality of downward sloping surfaces within the fluid accumulated within said fluid retainment vessel in inverse proportion to the distance of each of said downward sloping surfaces from said means of passing off excess fluid from said fluid retainment vessel.

35. The improvement of claim 34 further comprising baffle means for separating said plurality of said retardation means and said plurality of downward sloping surfaces into at least two sub-groups of said pluralities whereby desired materials of at least two distinguishable particle fluid-settling characteristics may be segregated from undesired material moving along said upwelling fluid flow.

36. The improvement of claim 27 further comprising means fluidly coupled to fluid accumulated in said fluid retainment vessel for increasing the velocity of said upwelling flow within the fluid so accumulated in said vessel.

37. The improvement of claim 36 wherein said means for increasing the velocity of said upwelling flow comprises fluid displacement means.

38. The improvement of claim 37 wherein said fluid displacement means comprises a plurality of fluid displacement plates for constricting the volume of said fluid retainment vessel through which said upwelling flow must pass.

39. In mineral separation apparatus having means for passing materials bearing minerals and similar substances past an upwelling flow of fluid wherein desired materials move counter to said upwelling flow to first collection means and undesired materials move along said upwelling fluid flow to second collection means, the improvement comprising:

a winnowing channel of finite length through which said materials must overcome a sustained region of relatively high pressure fluid flow in order to move counter thereto and having retardation means therein for retarding the counter movement of such materials as they enter within said upwelling fluid flow to increase the effective interaction time of said fluid flow on such materials as may enter said fluid flow and attempt to move counter thereto;

flow channel means coupled to said winnowing channel for channeling upwelling fluid flow to said winnowing channel and having means therein for increasing the pressure of said upwelling fluid flow to provide for a sustained region of relatively high pressure fluid flow within said winnowing channel;

means for coupling said first collection means to said winnowing channel downstream of said upwelling fluid flow for collecting in said first collection means material moved through said winnowing channel, said first collection means comprising flexible walled conduit;

recovery means comprising a fluid containing vessel fluidly coupled to said flexible walled conduit by fluid contained in said vessel;

fluid isolation means coupled to said first collection means for isolating said upwelling fluid flow from said recovery means while material is being recovered from said first collection means;

a downward sloping surface comprising said means for passing materials past an upwelling flow of fluid such that materials deposited on said downward sloping surface will be drawn by gravity toward said upwelling fluid flow;

a fluid retainment vessel for accumulating a sufficient volume of fluid from the upwelling flow to totally immerse said material as it is passed by said downward sloping surface to an upwelling flow of fluid;

material agitation means fluidly coupled to the fluid accumulated in said fluid retainment vessel for introducing materials to said accumulated fluid in a controlled manner to inhibit agitation of said accumulated fluid;

means for passing off fluid from said upwelling flow, which fluid is in excess of that accumulated in said fluid retainment vessel whereby material borne upward by said upwelling flow is passed off with said excess fluid; and means for immersing said downward sloping surface to a sufficient depth within the fluid accumulated in said fluid retainment vessel so as to inhibit fluid flow across said downward sloping surface.

40. The improvement of claim 39 further comprising a plurality of said winnowing channels and of said downward sloping surfaces.

41. The improvement of claim 40 wherein said retardation means within said winnowing channels and said downward sloping surfaces comprises surfaces inclined below the horizontal at angles comprising the repose angles of materials deposited on said surfaces under the fluid flow conditions established in operating said mineral separation apparatus.

42. The improvement of claim 41 further comprising means fluidly coupled to fluid accumulated in said fluid retainment vessel for increasing the velocity of said upwelling flow within the fluid so accumulated in said vessel.

43. The process whereby substances borne by a carrier material may be separated from said carrier material and segregated one from the other comprising the steps of:

(a) presizing said carrier material and the substances carried thereby by passing said material through two or more stages of screening;

(b) selecting screen mesh size of each stage of screening by relating adjacent stage screen mesh sizes to the specific gravities of the two substances borne by said material having the greatest specific gravities in accord with the formula $$M_2/M_1=(G/g\,K)$$

wherein $M_2$ is the screen mesh size of a prior adjacent stage screen and $M_1$ is the size of the succeeding adjacent stage screen, G is the greater and g is the lesser specific gravity of the two substances, and K is an empirical value determined by the particulate fluid-settling characteristics of the substances such that material accumulating between adjacent stages of screening will comprise particles of the substances of specific gravity g which will move along an upwelling flow of fluid within a body of fluid and particles of the substances of specific gravity G will move counter to such upwelling flow of fluid;

(c) introducing screened material from a selected stage of screening into a body of fluid in a manner controlled so as to inhibit agitation of said fluid;

(d) utilizing the influence of gravity rather than fluid movement to introduce said screened material to an upwelling flow of fluid within said body of fluid;

(e) winnowing such screened material as moves counter to said upwelling fluid flow by directing such counter movement through a contained finite length of controlled relatively high velocity upwelling fluid flow; and (f) collecting such winnowed counter moving material in collection means permitting the recovery of such material without modulation of the upwelling flow of fluid.

44. Means for recovering substances settling to the bottom of fluid containing vessels while inhibiting agitation of such fluid comprising:

collection means coupled to the bottom of a vessel for accepting therein substances settling through fluid contained in said vessel and said collection means and having an open end through which may pass substances accepted by said collection means; and pressure means for inhibiting the flow of fluid through said open end of said collection means while permitting the easy passage of settling substances therethrough.

45. The recovery means of claim 44 wherein said pressure means comprises:

a fluid body into which said open end of said collection means is immersed; and means for reducing the pressure head of fluid above said open end of said collection means below the level of pressure exerted by said fluid body.

46. The recovery means of claim 45 wherein said collection means comprises a flexible walled conduit.

47. The recovery means of claim 46 wherein said means for reducing the pressure head of fluid above said open end of said collection means comprises:

first compression means for releasably compressing said flexible walled circuit above said open end and retaining settling substances in the region of such compression; and second compression means coupled to said flexible walled conduit intermediate said first compression means and said fluid containing vessel for releasably compressing said flexible walled conduit, said first and said second compression means being operative such that both said first and said second compression means must compress said flexible walled conduit before either one of said compression means releases said conduit of compressive forces exerted thereby.

* * * * *

UNITED STATES PATENT AND TRADEMARK OFFICE

CERTIFICATE OF CORRECTION

PATENT NO. : 4,388,182

DATED : 14 June 1983

INVENTOR(S) : H. Gene Hudson

It is certified that error appears in the above—identified patent and that said Letters Patent is hereby corrected as shown below:

Claim 1 Line 9 (Col. 20 Line 4 - delete "they"

Claim 47 Line 5 (Col. 25 Line 5) change "circuit" to - - conduit - -

Signed and Sealed this

*Thirtieth* Day of *August 1983*

[SEAL]

*Attest:*

GERALD J. MOSSINGHOFF

*Attesting Officer*

*Commissioner of Patents and Trademarks*